US006241197B1

(12) United States Patent
Harland

(10) Patent No.: US 6,241,197 B1
(45) Date of Patent: Jun. 5, 2001

(54) AUTOMATED RAIL WAY CROSSING

(76) Inventor: Sydney A. Harland, 2155 Winchester Court, Burlington, ON (CA), 3M7 L7P ( * ) Notice: Subject to any disclaimer, the term of this patent is extended or adjusted under 35 U.S.C. 154(b) by 0 days.

(21) Appl. No.: 09/235,389

(22) Filed: Jan. 22, 1999

Related U.S. Application Data

(60) Provisional application No. 60/072,314, filed on Jan. 23, 1998.

(51) Int. Cl.[7] ..... B61L 29/24

(52) U.S. Cl. ..... 246/293; 246/125; 246/294; 246/295; 246/296; 246/473.1; 701/19; 701/20; 701/204; 701/205; 340/941

(58) Field of Search ..... 246/125, 127, 246/293, 294, 295, 296, 473.1, 297, 167 A; 701/19, 20, 204, 205; 340/941, 903, 902, 904

(56) References Cited

U.S. PATENT DOCUMENTS 5,092,544 * 3/1992 Petit et al. ..... 246/126
5,590,855 * 1/1997 Kato et al. ..... 246/202
5,735,492 * 4/1998 Pace ..... 246/125
5,864,304 * 1/1999 Gerszberg et al. ..... 340/903
5,954,299 * 9/1999 Pace ..... 246/293

* cited by examiner

*Primary Examiner*—S. Joseph Morano
*Assistant Examiner*—Frantz F. Jules
(74) *Attorney, Agent, or Firm*—Lieberman & Brandsdorfer, LLC

(57) ABSTRACT

A device for monitoring the passage of a train traveling through a rail way crossing, said device including a first and second sensors for sensing the presence of the train on a rail track when the train is in proximity to the sensors, said first and second sensors positioned adjacent the track, first and second processors opperatively coupled to the first and second sensors, respectively, the processors adapted to monitor the sensors and determine the speed and direction of the train when the train passes the sensors. The device also includes a signal positioned adjacent the crossing for signaling the public that a train is about to enter the rail way crossing, and a third processor operatively coupled to the signal and operatively coupled to the first and second processors, the third processor adapted to activate the signal when the train is within a predetermined time interval from entering the crossing.

10 Claims, 5 Drawing Sheets

AUTOMATED RAIL WAY CROSSING

This is a non-provisional utility patent application claiming benefit of the filing date of U.S. provisional application Serial. No. 60/072,314 filed Jan. 23, 1998, and titled AUTOMATED RAILWAY CROSSING.

FIELD OF THE INVENTION

The present invention relates to a modular commuications system that monitors train movements and provides warning systems for rail and highway grade crossings.

BACKGROUND OF THE INVENTION

Rail is an important method of transporting goods and people to and from populated areas. Since rail lines often intersect with road ways or pedestrian crossings, collisions between trains and other traffic often occur. Preferably, rail lines are separated from pedestrian or automobile traffic by overpasses. Not all crossings have sufficient traffic to justify the expense of building an overpass, and in many cases where expense is not an issue, the construction of an overpass is not practical. Where no overpass is possible, the rail lines must cross over the road or pedestrian walk way. To ensure collisions are avoided at rail crossings, rail transport companies often install signal devices designed to warn motorists of the rail crossing. In areas where there is significant rail traffic, these rail crossings may be engineered to autonmatically activate flashing lights, closing gates or auditory alarms when trains approach the crossing.

Automated rail crossings generally consist of a sensor coupled to a control device which is in turned coupled to a signal. The control devices are generally straight forward devices designed to activate the signal as soon as the train reaches the sensor. The sensor is generally positioned several meters away from the crossing thereby ensuring that the signal will be activated before the train reaches the crossing. It is critically important that the signal is activated well before the train enters the crossing so that mototsts and pedestrians will have time to either clear the crossing or come to a stop before entering the crossing. In most jurisdictions, the speed at which a trains can approach an automated crossing is strictly limited to ensure that the signals are active for at least a certain period of time before the train enters the crossing.

Existing automated rail way crossings, while a significant improvement over non automated crossings, suffer from several draw backs. In paticular, automated rail way crossings are triggered by either fast moving or slow moving trains. Since a slow moving train will necessarily take longer to enter a crossing than a faster moving train, the signal will be active for a relatively longer period of time. As a result, traffic is interrupted for a longer period of time. Also, existing crossings do not permit rail way corporations to adjust the time interval that the signal shall operate before the train enters the crossing, therefore, the operating time of the signal cannot be optimized for time of day or traffic conditions. There remains a need for an automated rail crossing which can adjust for train speed.

SUMMARY OF THE INVENTION

The present invention is an automated rail crossing for signaling the approach of a train into a rail crossing. The rail crossing includes first and second sensors positioned adjacent the track and adapted to sense the presence of the train on the rail track when the train is in proximity to the senors, the sensors being located on either side of the crossing. The crossing also has first and second processors operatively coupled to the first and second sensors, respectively, the processors adapted to monitor the sensors and determine the speed and direction of the train when the train passes the sensors. The crossing has a signal positioned adjacent the crossing for signaling the public that a train is about to enter the rail way crossing. Finally, the crossing includes a third procesor operatively coupled to the signal and operatively coupled to the first and second processors, the third processor is adapted to activate the signal when the train is within a predetermined time interval from entering the crossing.

BRIEF DESCRIPTION OF THE FIGURES

Further features and advantages of the method and device embodying the present invention will now be described and made clearer from the ensuing descrption, refercnce being had to the accompanying drawing in which.

DETAILED DESCRIPTION OF THE INVENTION

Figure 1:
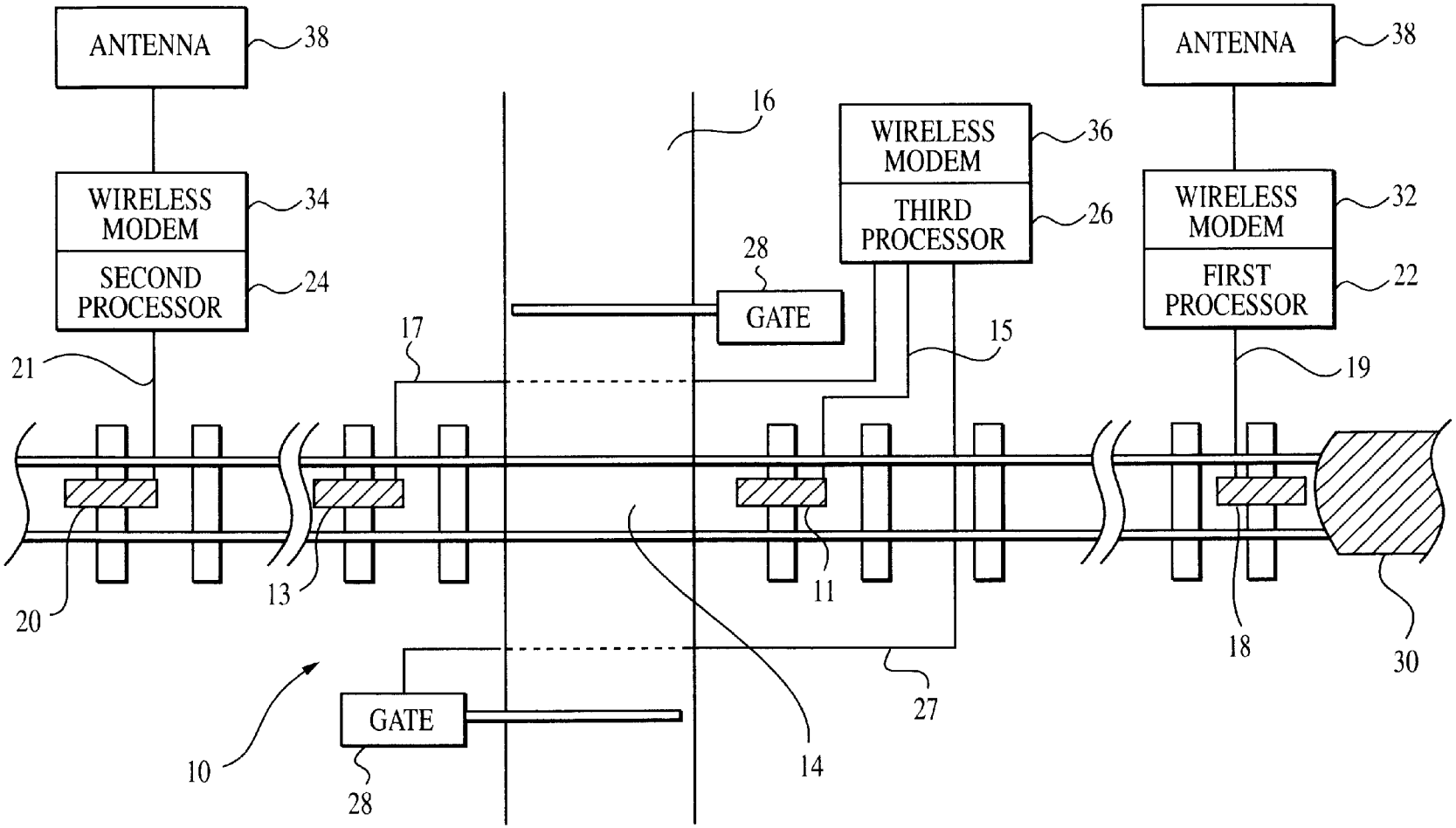
FIG. 1 is a top view of the present invention showing a train moving towards a rail way crossing.

Referring firstly to FIG. 1, the present rail way crossing, shown generally as item 10, is positioned at the intersection 14 of rail line 12 an roadway 16. Rail line 12 is provided with a first sensor 18 and a second sensor 20 located on opposite sides of the rail line relative to the roadway. First sensor 18 is operatively coupled to first processor 22 via cable 19 Likwise, second sensor 20 is coupled to second processor 24 via cable 21. First and second processors 22 and 24 are operatively coupled to third processor 26 via wireless modens 32 ad 34. Third processor 26 is provided with wireless modem 36 adapted to receive signals from wireless modems 32 and 34. Rail line 12 is further provided with sensors 11 and 13 positioned adjacent intersection 14 on either side of roadway 16. Sensors 11 and 13 are each coupled to third processor 26 via cables 15 and 17 respectively. Third processor 26 is operatively coupled to signal 28 via cable 27.

Figure 2:
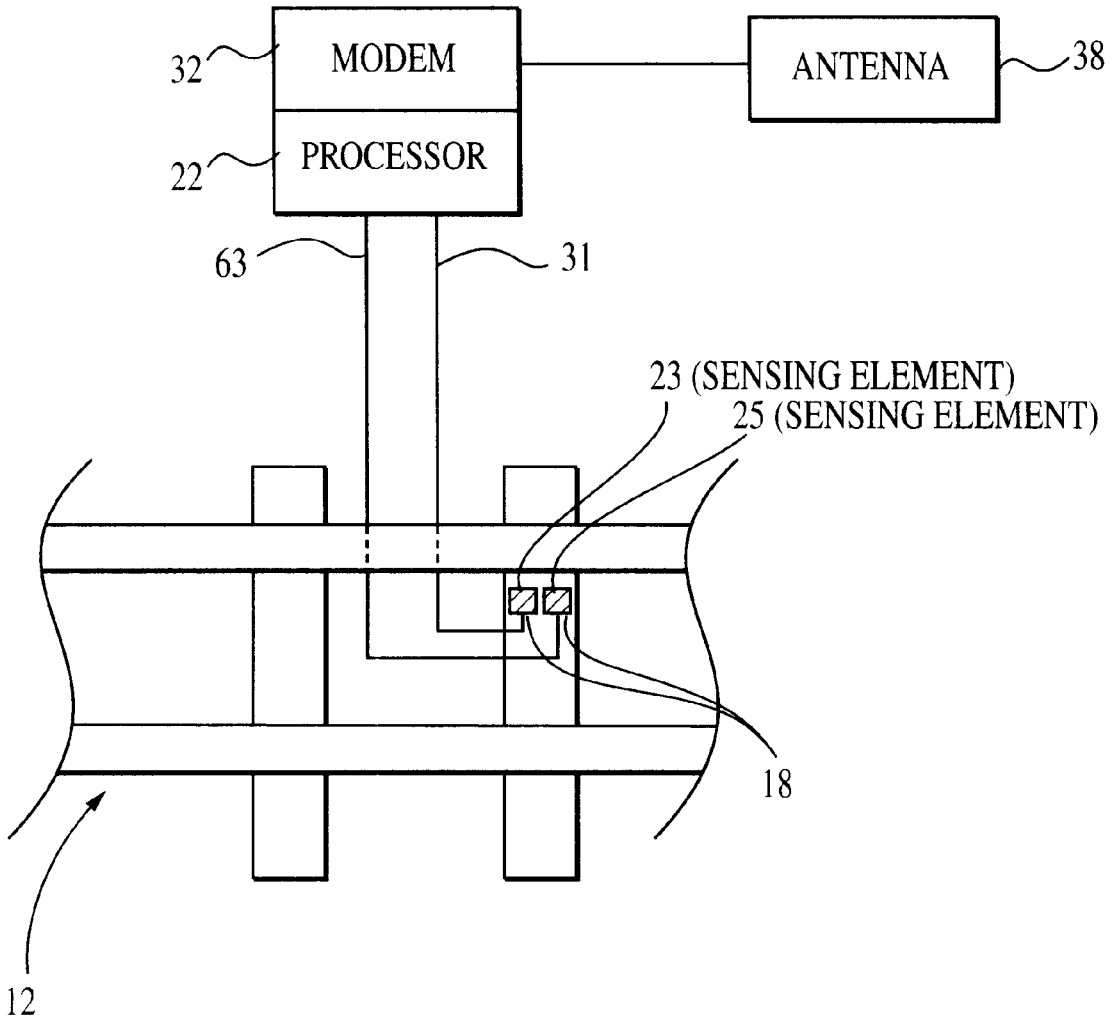
FIG. 2 is a top view of a portion of the invention showing the first sensor in relation to the first processor.

Referring now to FIG. 2, the first and second sensors shall now be discussed with reference to sensor 18 which is identical to sensor 20. Sensor 18 is positioned adjacent track 12 at a distance of about one kilometer or more from the roadway. A variety of sensors are available for use in the present invention. Sensor 18 may comprise an inductive sensor which measures the presence of the train by measuring changes in the impedance of a wire coil positioned adjacent the rails of the train. Alternatively, the sensors may comprise simple switches which are operated upon physical contact with the passing train or optical detectors which sense when a light beam passing across the rails are broken by a passing train.

Preferably sensor 18 comprises two sensing elements 23 and 25, operatively coupled to processor 22 via cables 23 and 35 respectively. Sensing elements 31 and 33 are positioned some distance apart along the track such that each sends a separate electronic signal to processor 22 when a train passes. Since one sensing element will send a signal to processor 22 before the other sensing element, processor 22 can calculate the difference in time between the electron signals. The distance separating sensing elements 23 and 25 depend on the type of sensng elements used. If sensing elements 23 and 25 comprise impedance type sensing devices, then the sensing elements may be separated by only a few centimeters. Alternatively, if sensing elements 23 and 25 comprise optical beam sensors or switches, then the sensing elements may be separated by as much as a meter or more to enable processor 22 to accurately detemine the speed of the oncoming train.

Figure 3:
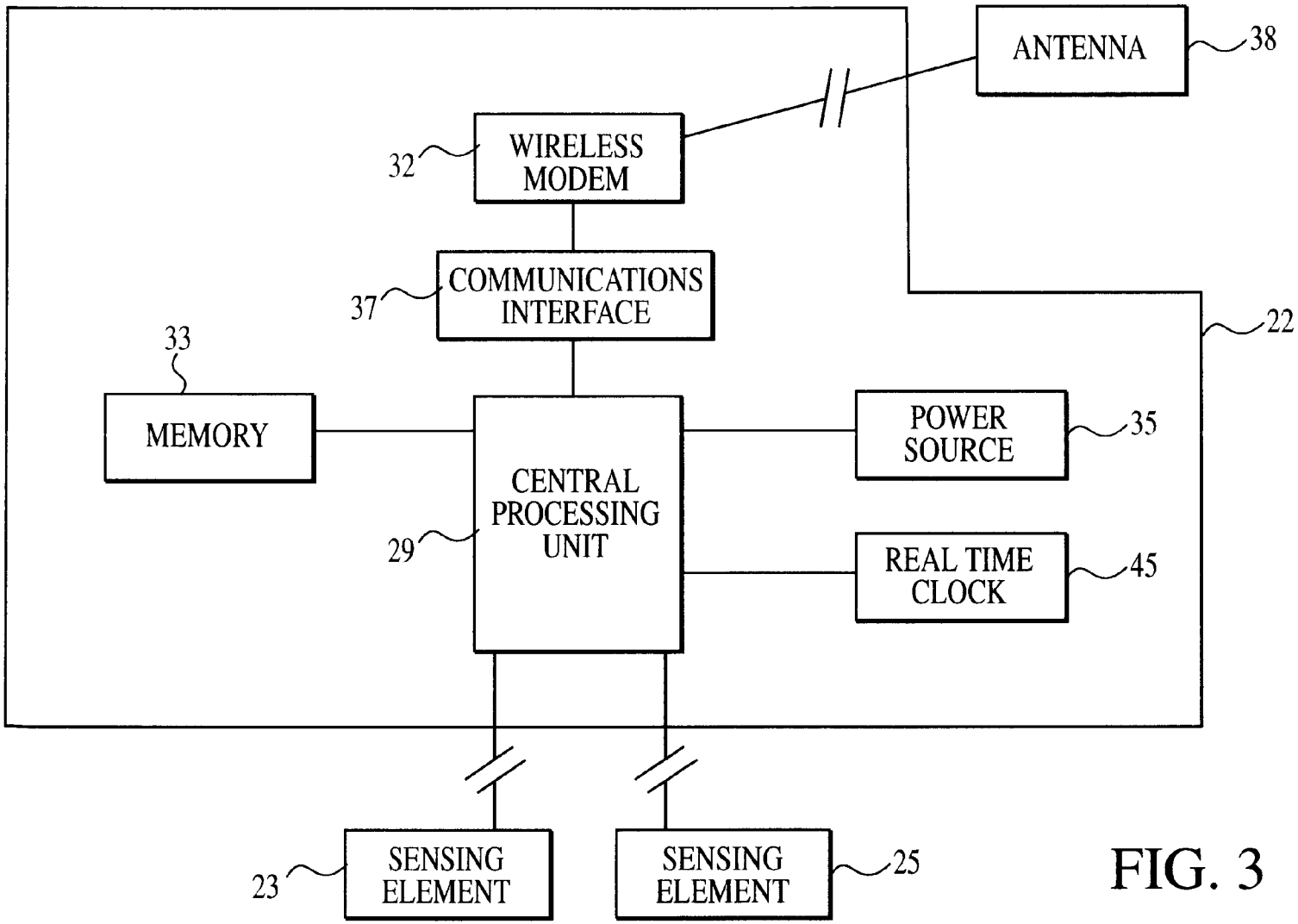
FIG. 3 is a schematic view of the first processor.

Referring now to FIG. 3. procssor 22 comprises a central processing unit 29 operatively coupled to memory 33, real time clock 45 and power source 35 by means known generally in the art. Memory 33 will store the software required by the processor to calculate the speed and direction of the train from the electronic signals received by sensing elements 23 and 25. The distance between sensing elements 23 and 25 is stored in memory 33, therefore enabling processor 22 to determine the speed of passing trains by dividing the distance between the sensing elements by the time interval between the signals received from the two sensing elements. Processor 22 can also calculate the direction the train is traveling by noting which sensing elements sends the first electronic sensor. Preferably, sensing elements 25 and 23 are sufficiently precise that they can signal central processing unit 29 with each train wheel that passes, enabling the processor to count the number of wheels passing the sensing elements. The number of wheels counted may be stored in memory 33, together with the speed and direction of the passing train. Central processing unit 29 may comprise any high speed processor such as a Pentium™ 486 or greater. Central processing unit 29 and memory 33 are mounted on a suitable board. Pre fabricated boards having suitable processors and memory as well as additional supporting circuitry are commercially available.

Central processing unit 29 is operatively coupled to a communications interface 37 which is in turn operatively coupled to wireless modem 32. Wireless modem 32 comprises a high speed communications radio modem adapted to operate at 19 K baud. Wireless modem 32 has an effective range sufficient to reliably communicate with third processor 26. Wireless modem 32 is operatively coupled to antenna 38 which is preferably mounted on a tower to increase the effective range of the modem.

Central processing unit 29, memory 33, sensing elements 23 and 25 and wireless modem 32 are all powered by power source 35. Power source 35 can be a simple rectified transformer coupled to line current. Alternatively, power source 35 can be a battery backed solar energy source.

Figure 4:
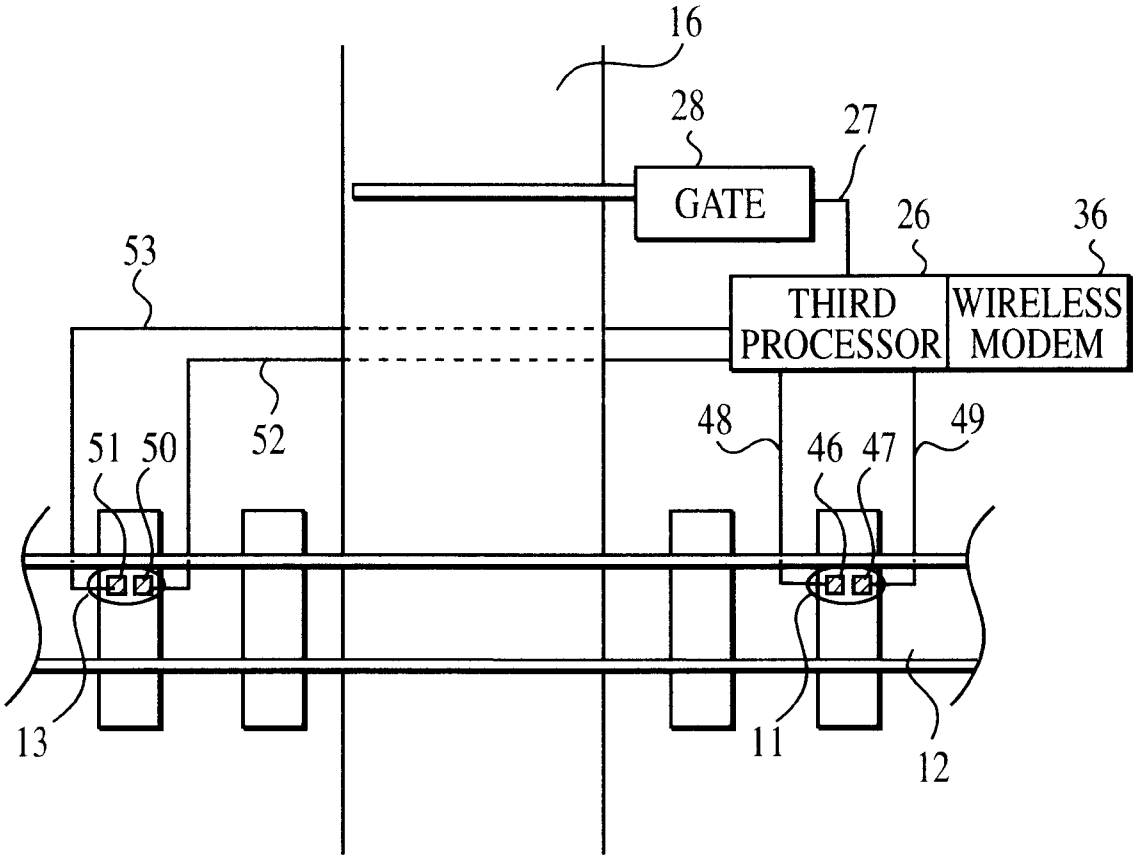
FIG. 4 is a top view of a portion of the invention showing the third and forth sensors in relation to the third processor.

Referring now to FIG. 4, sensor 11 comprises elements 46 and 47 operatively coupled to processor 26 by cables 48 and 49 respectively. Sensor 13 comprises sensing elements 50 and 51 coupled to processor 26 by cables 52 and 53 respectively. Sensing elements 46, 47, 50 and 51 may comprise eddy current sensors, optical sensors or simple switches which are sufficiently precise to signal the passage of an individual train wheel. Suitable magnetic sensors adapted to count individual train wheels are commercially available.

Figure 5:
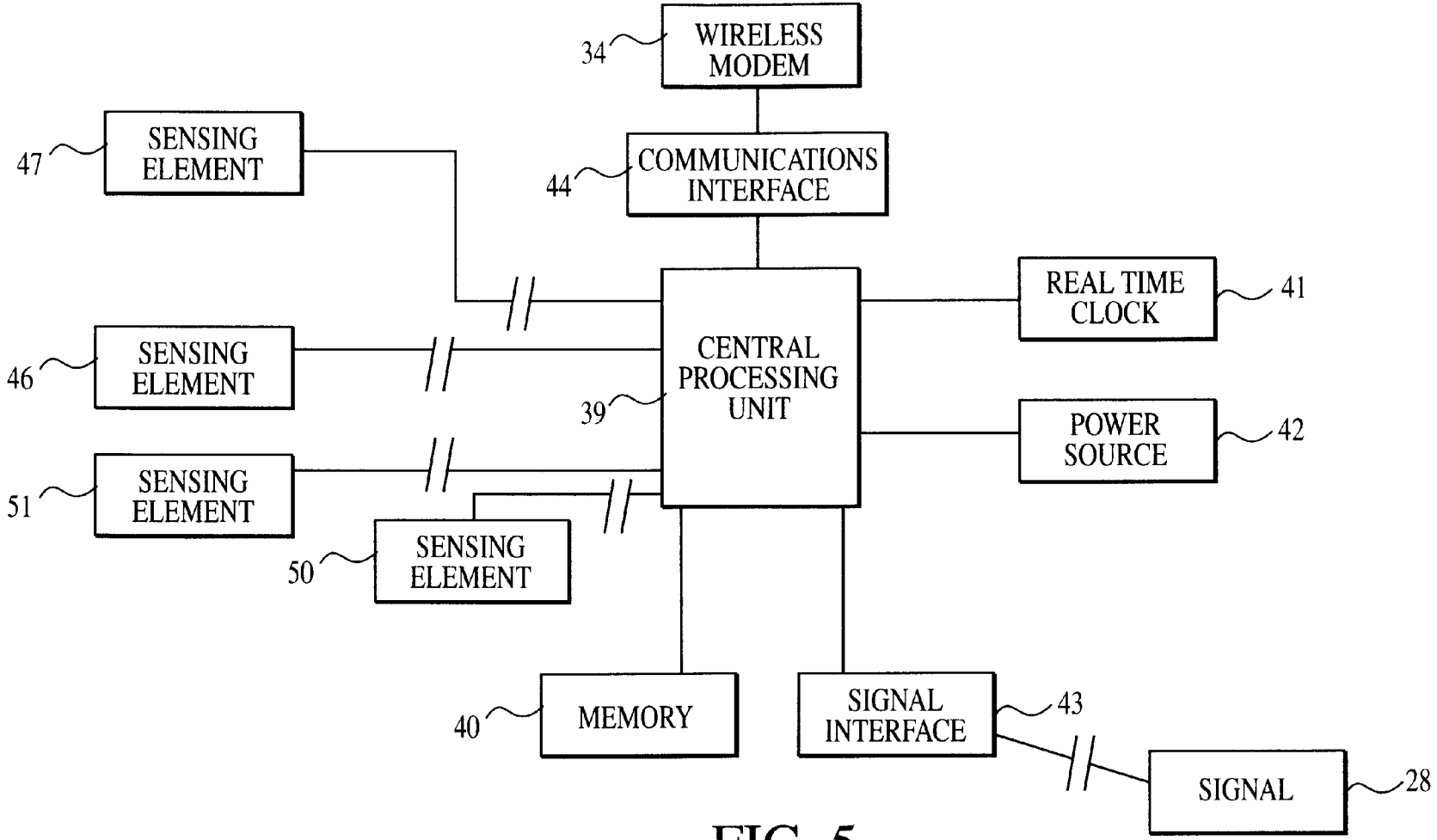
FIG. 5 is a schematic view of the third processor.

Referring now to FIG. 5, third processor 26 comprises a central processing unit 39 operatively coupled to memory 40, power source 42, communications interface 44, real time dock 41, wireless modem 36 and signal interface 43 operatively coupled to signal 28. Central processing unit 39 preferably comprises any high speed CPU such as an Intel™ pentium or greater. Central processing unit 39, memory 40, and communications interface 44 may all be mounted to the same board. Pre fabricated boards having suitable central processors, memory and communications interfaces are commercially available. Wireless modem 36 is adapted to receive data from wireless modems 32 coupled to the first and second processors. The distance between sensors 18 and 20 and the intersection is recorded into memory 40 along with a simple program for calculating the estimated time of arrival of the train at the intersection from the speed of the train, said program enabling CPU 39 to calculate the estimated time of arrival by dividing the distance by the speed of the train. Memory 40 is also pre-loaded with the selected safe time interval for activating signal 28 before arrival of the train the intersection. Memory 40 is further pre-loaded with instructions enabling CPU 39 to calculate the time interval between the estimated time of arrival of the train and the minimum safe time, and then activate signal 28 when said interval expires. Real time clock 41 enables CPU 39 to measure the passage of time.

Central processing unit 39 it provided with instructions pre-loaded into memory 40, for storing data concerning the time, date and speed of trains passing the crossing. Wireless modem 34 preferably comprises a high speed wireless modem operatively coupled to a communications line commonly referred to as a T1, thereby enabling high speed communications with remote sites. Information stored in memory 40 may be downloaded by remote users via the T1 line. Alternatively, instructions and data, such as revised minimum safe times, may be up loaded into memory 40 by remote users.

Referring now to FIGS. 1, 2, 3 and 4, the operation of the invention will now be explained. Train 30 approaching road 16 triggers sensor 25 and then sensor 23. Sensors 25 and 23 each send a signal to first processor 22 as soon as they are triggered. First processor 22 then calculates the speed of the approaching train by dividing the distance between sensors 25 and 23 by the time interval between the signals from the two sensors. First processor 22 then transmits the speed of the approaching train to the third processor via wireless modems 32 and 36. First processor 22 then counts the number of train wheels passing sensors 25 and 23 and relays this information to third processor 26. Third processor 26 then calculates the estimated time of arrival of train 30 at intersection 14 by dividing the distance from sensors 23 and 25 to roadway 16 by the speed of the train. Third processor 26 then calculates the time interval before activating signal 28 by subtracting the estimated time of arrival from the pre-loaded minimum safe time and then immediately activates the signal when said time interval expires. Processor 26 stores the date, time and speed of the passing train together with the number of wheels counted by sensors 23 and 25 in memory 40. As train 30 approaches intersections 14, sensor 11 counts the number of wheels on the train entering the intersection and sensor 13 calculates the number of train wheels the exiting the intersection. Third processor 26 then compares the number of wheels entering and exiting intersection 14 and the number of wheels which passed sensor 18; if the number of wheels entering the intersection or passing sensor 18 exceeds the number of wheels which have exited the intersection then third processor 26 keeps signal 28 activated. When processor 26 measures the as of the trains wheels past sensor 13, the processor then opens gate 28. Users located at a remote site may access information, such as reports on train traffic through the crossing, stored in memory 40.

The invention having been so described, certain modifications and adaptations will be obvious to those skilled in the art. The invention includes all such modifications and adaptations which follow in the scope of the appended claims.

What is claimed is:

1. A device for monitoring the passage of a train traveling through a railway crossing, said device comprising:

first and second sensors for sensing the presence of the train on a rail track when the train is in proximity to the sensors, said first and second sensors positioned adjacent to the track on opposite sides of the railway crossing at a first and second distance from the crossing;

first and second processors operatively coupled to the first and second sensors, respectively, said first and second processors adapted to monitor the sensors and determine the speed and direction of the train when the train passes the sensors;

a signal positioned adjacent to the crossing for signaling the public that the train is about to enter the railway crossing, a third processor operatively coupled to the signal and operatively coupled to the first and second processors by radio modems, the third processor is adapted to activate the signal when the train is within a predetermined time interval from entering the crossing, and is further adapted to activate the signal after a second time interval following the passage of the train past any one of said sensors, wherein the second time interval is calculated by dividing the relevant distance by the speed of the train;

said first processor is operatively coupled to a first radio modem, the second processor is operatively coupled to a second radio modem, and the third processor is operatively coupled to a third radio modem, wherein the third processor is operatively coupled to a communication line and the third processor is adapted to transmit data concerning the passage of the train to users via the communication line.

2. The device of claim 1, further comprising third and fourth sensors positioned adjacent to the track on either side of and adjacent to the intersection, wherein the third and fourth sensors are operatively coupled to tile third processor and the first, second, third and fourth sensors.

3. The device of claim 2, wherein the first, second, third and fourth sensors are adapted to signal their respective processors when each of the train wheels pass the sensors.

4. The device of claim 3 wherein the first, second and third processors are adapted to count the number of wheels on the train as the train passes the sensors.

5. The device of claim 4, wherein the third processor is adapted to keep the signal activated until all of the train wheels pass the intersection.

6. The device of claim 1, wherein the third processor is adapted to receive programming instructions from said users via the communication line.

7. The device of claim 1, wherein the communication line is a T1 server.

8. The device of claim 7, wherein the T1 server comprises a radio.

9. The device of claim 1, wherein said sensors are selected from the group consisting of: eddy current sensors, optical sensors, and switch sensors.

10. The device of claim 1, wherein said sensors are magnetic sensors.

* * * * *